US005177828A

United States Patent [19]

Von Vett

[11] Patent Number: 5,177,828

[45] Date of Patent: Jan. 12, 1993

[54] MISSING PAD DETECTOR FOR A FLOOR POLISHING TOOL

[75] Inventor: Peter W. Von Vett, Englewood, Colo.

[73] Assignee: Windsor Industries, Inc., Englewood, Colo.

[21] Appl. No.: 747,383

[22] Filed: Aug. 20, 1991

[51] Int. Cl.[5] ..... A47L 11/14

[52] U.S. Cl. ..... 15/98; 15/49.1; 51/177

[58] Field of Search ..... 15/49.1, 50.1, 50.2, 15/50.3, 52.1, 52.2, 98, 385; 51/174-177; 299/39, 41

[56] References Cited

U.S. PATENT DOCUMENTS 3,129,539 4/1964 Tempero ..... 15/49.1

3,496,681 2/1970 Oswald ..... 15/49.1

4,674,142 6/1987 Meili ..... 15/49.1

5,056,175 10/1991 Stein et al. ..... 15/49.1

*Primary Examiner*—Edward L. Roberts

*Attorney, Agent, or Firm*—W. Scott Carson

[57] ABSTRACT

A surface treating tool such as a floor polisher and method and apparatus for detecting the absence of a pad or other surface treating member on the tool. In the preferred manner of operation, the invention monitors the amperes being drawn by an electric motor rotating the pad support. If the amperage draw during initial start up of the tool is less than a predetermined amount (representing the absence of a pad on the support), the tool is prevented from lowering the padless support into potentially damaging contact with the floor or other surface.

12 Claims, 6 Drawing Sheets

Fig. 6
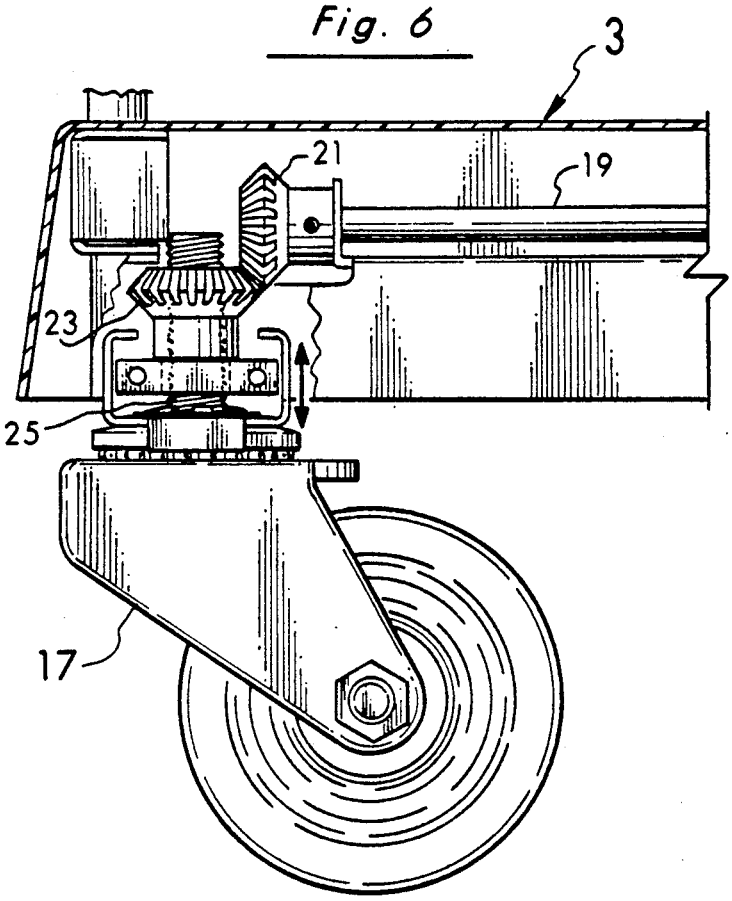
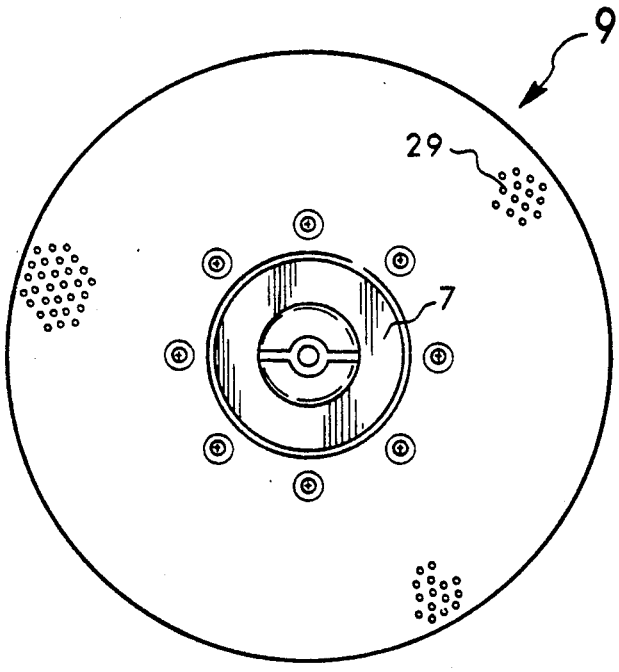
Fig. 7

MISSING PAD DETECTOR FOR A FLOOR POLISHING TOOL

FIELD OF THE INVENTION

This invention relates to the field of surface treating tools such as floor polishers. More specifically, it is directed to methods and apparatus for automatically detecting the absence of a surface treating member such as a floor pad on such tools and operating the tool according to avoid damaging the floor or other surface.

DISCUSSION OF THE BACKGROUND

In surface treating tools such as floor polishers, the surface treating member (e.g., floor pad) is typically rotated about an axis to polish or otherwise treat a surface such as a floor. The tool commonly includes a frame which has a rotatable support to which the pad is removably attached. In operation, the pad is mounted on the support wherein the support and pad are rotated at relatively high speeds about an axis as the tool is moved across the floor. The pad and its support are often adjustable so that the pad can be vertically lowered and raised relative to the floor to selectively increase and decrease the pad pressure on it. In more sophisticated models, such pad pressure on the floor is monitored and the pad automatically raised or lowered to maintain a desired pressure or range of pressures.

One problem that can and does often arise with such tools is that the operator may neglect to check to see that a pad is mounted on the tool before operating it. In this regard, the support for the pad is not intended to contact the floor as it will grind or otherwise damage it. Consequently, if the operator neglects to make sure a pad is present, the tool may end up lowering the padless support into engagement with the floor potentially resulting in significant damage to the floor as well as to the tool itself.

To prevent this, the present invention was developed. With it, the absence of a pad on the tool is automatically detected and the tool operated accordingly to prevent the padless support from being lowered into engagement with the floor.

SUMMARY OF THE INVENTION

This invention involves a surface treating tool such as a floor polisher and method and apparatus for detecting the absence of a pad or other surface treating member on the tool. In the preferred manner of operation, the invention monitors the amperes being drawn by an electric motor rotating the pad support. If the amperage draw is less than a predetermined amount (representing the absence of a pad on the support), the tool is prevented from lowering the padless support into potentially damaging contact with the floor or other surface. In this regard, the motor for rotating the pad support draws different amounts of amperes depending upon whether or not a pad is present on the support (e.g., more than seven amperes with a pad versus fewer than seven amperes without a pad). As the tool is started, the pad support is at or raised to an up position away from the floor and begun to rotate. Initial amperage draw is relatively high but quickly falls to the normal operating range of, for example, 11-15 amperes as the pad support comes up to normal operating speed (e.g., 1500 or 2000 rpm's). With the pad still spaced from the floor, the automatic detector of the present invention monitors the amperage draw and if it falls below the predetermined amount (e.g., fewer than seven amperes) representing the absence of a pad on the support, the detector will interrupt the normal descent of the rotating support member toward the floor and prevent it from making potentially damaging contact with it.

BRIEF DESCRIPTION OF THE DRAWINGS

FIG. 6 is an enlarged, cross-sectional view of the mechanism for raising and lowering the pad and its support relative to the floor.

FIG. 7 is a view taken along line 7—7 of FIG. 5 showing the support to which the pad is removably mounted.

DETAILED DESCRIPTION OF THE PREFERRED EMBODIMENTS

Figure 1:
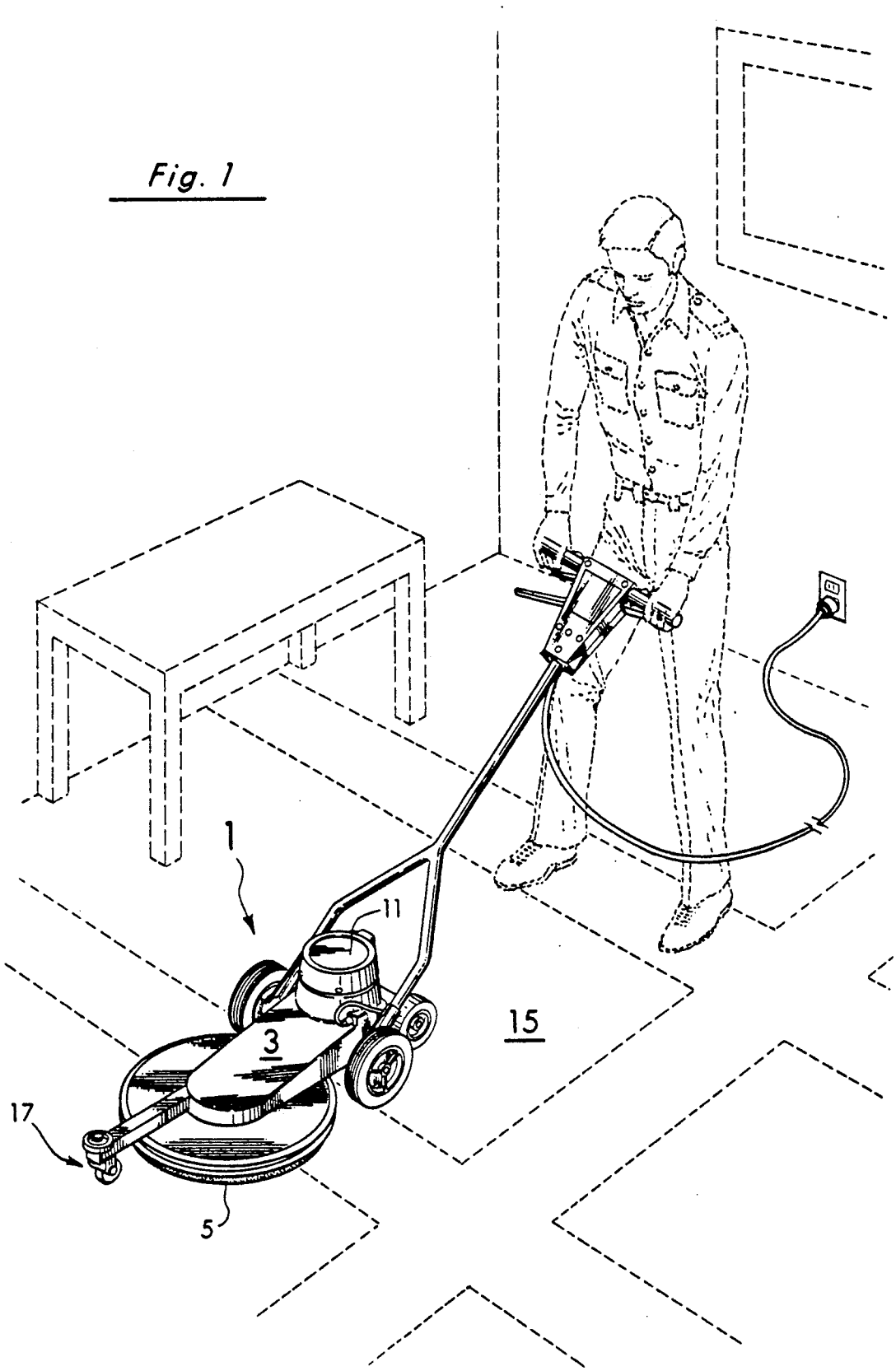
FIG. 1 illustrates a floor polishing tool incorporating the present invention.
Figure 2:
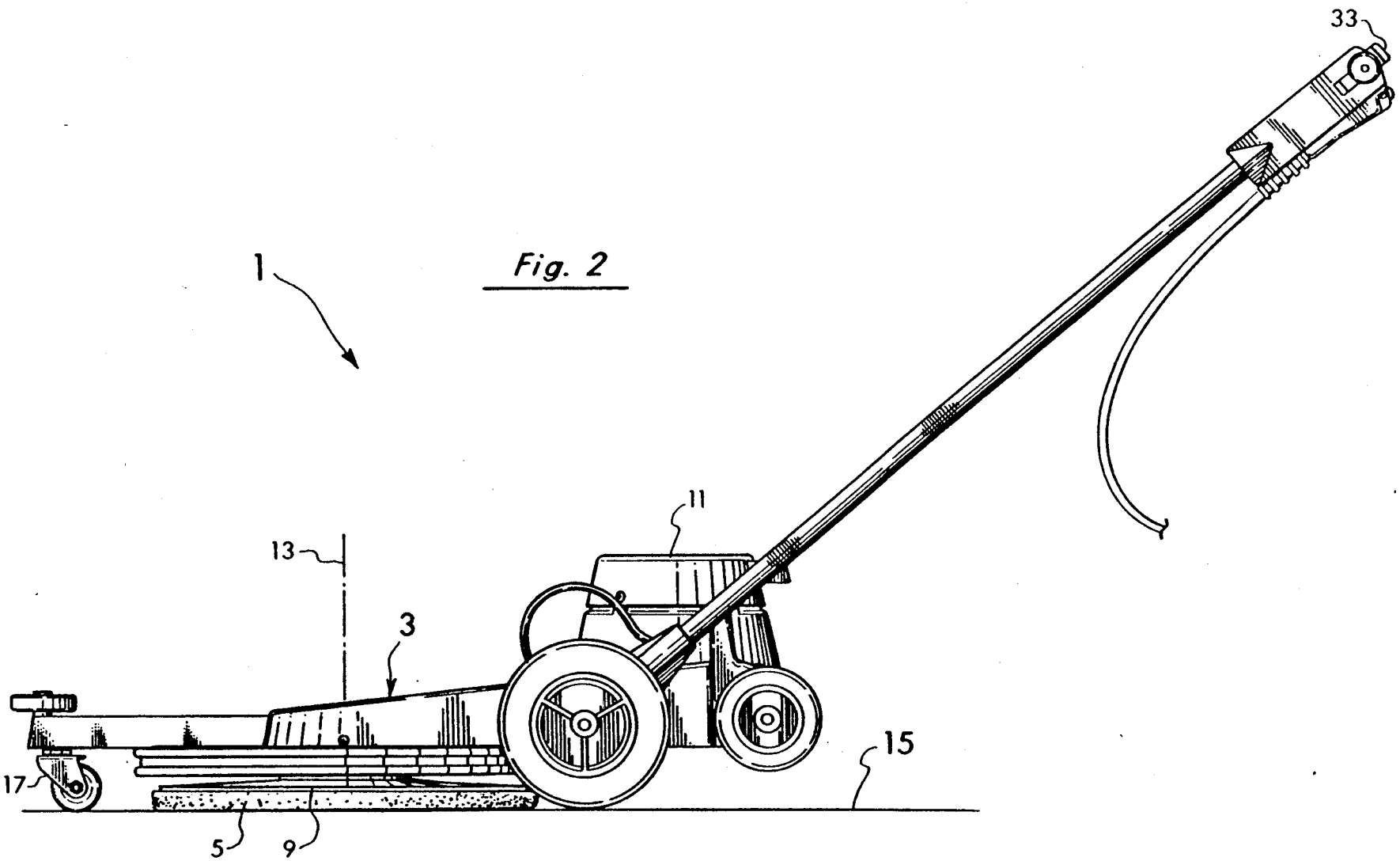
FIG. 2 is a side elevational view of the tool.
Figure 3:
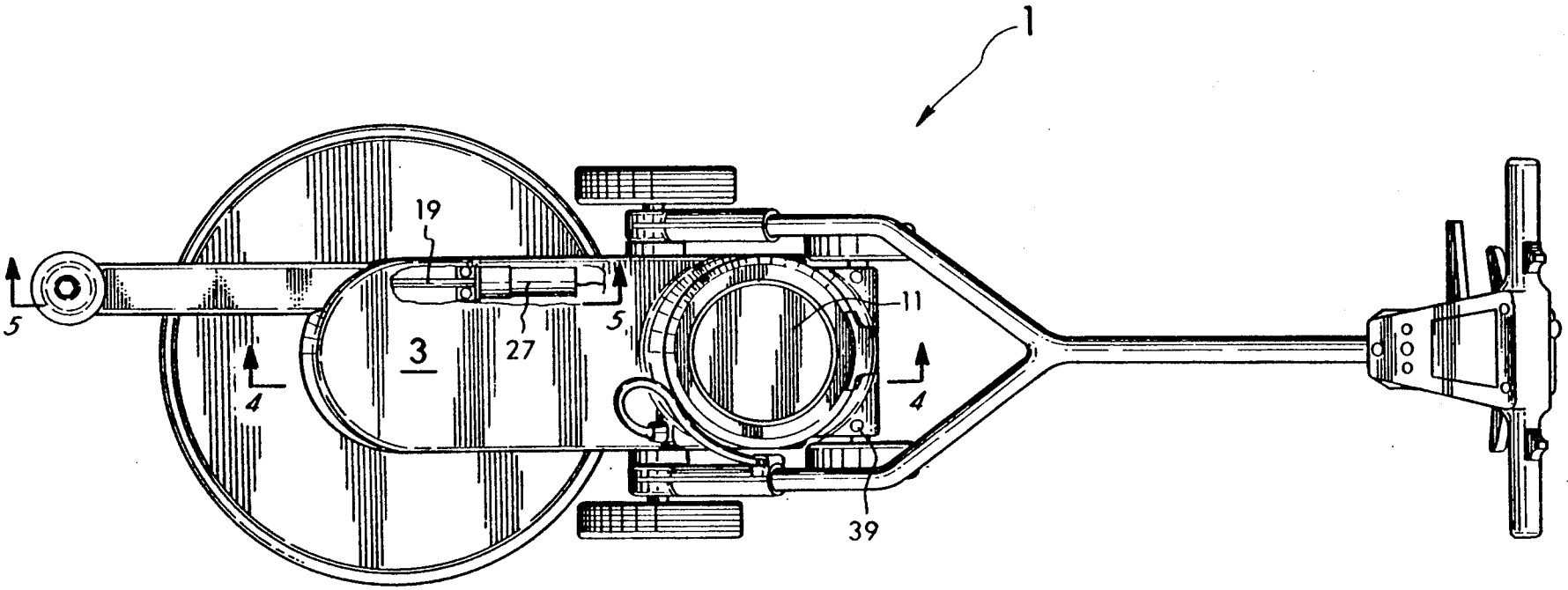
FIG. 3 is a plan view of the tool.

The method and apparatus of the present invention are primarily intended for use with surface treating such as the floor polishing tool 1 of FIGS. 1-3. As shown, the tool includes a frame 3 and surface treating member 5 (e.g., floor polishing pad). The pad 5 (see FIG. 4) is removably mounted at 7 to the pad support 9 wherein operation of the electric motor 11 will then serve to rotate the pad support 9 and attached pad 5 at a relatively high speed (e.g., 1500-2000 rpm's) about the axis 13.

Figure 4:
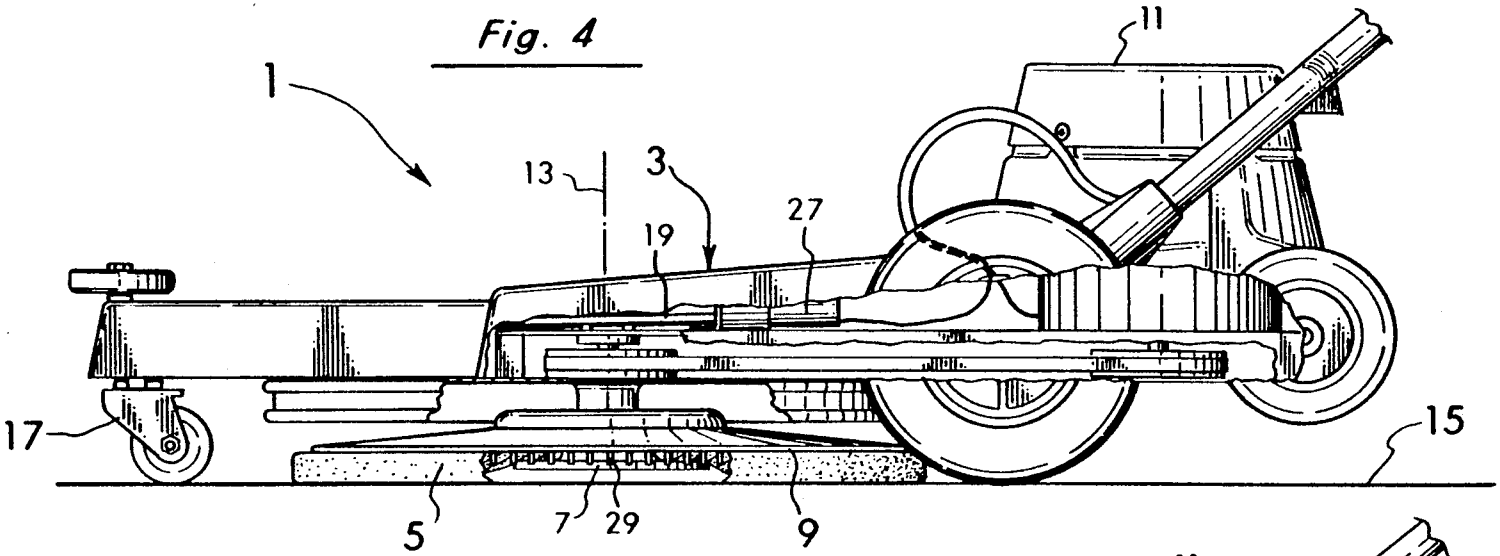
FIG. 4 is a view taken along line 4—4 of FIG. 3 illustrating the tool with the floor pad engaging the floor.
Figure 5:
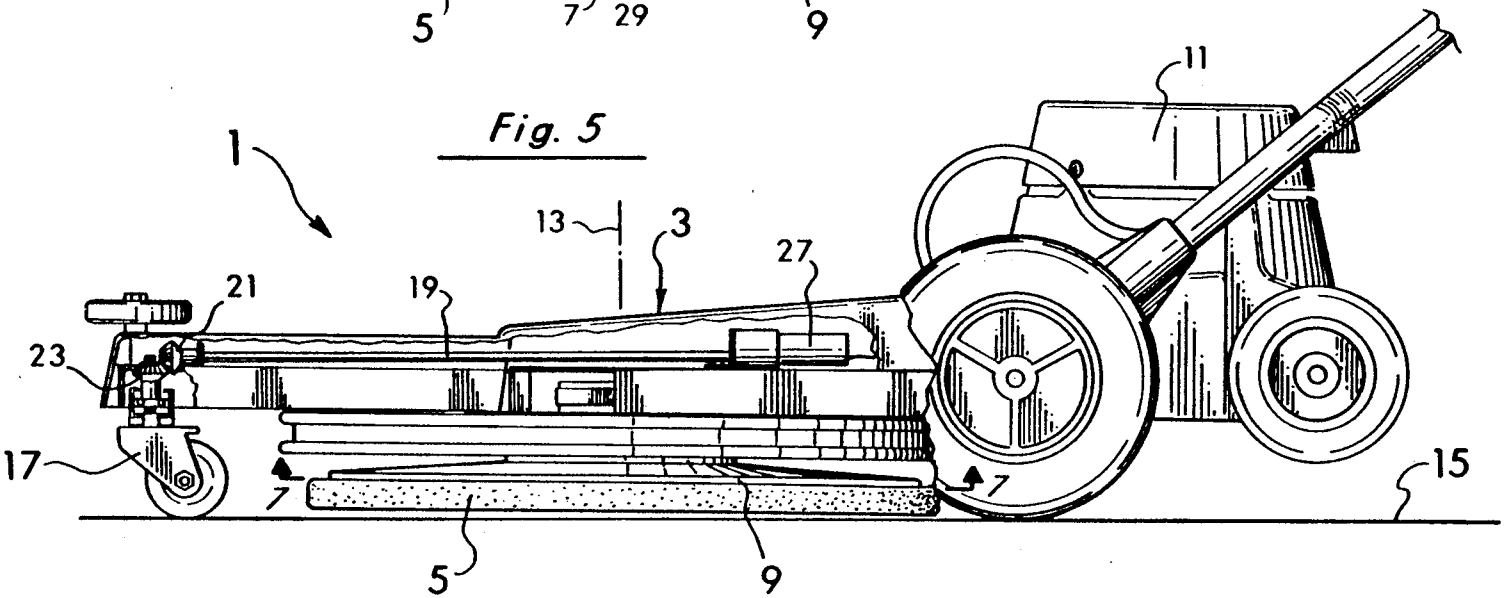
FIG. 5 is a view taken along line 5—5 of FIG. 3 illustrating the tool with the pad spaced from engagement with the floor.

In operation, the height of the pad support 9 and attached pad 5 is adjustable relative to the surface 15 (e.g., floor) to be treated. This adjustability can be accomplished in any number of manners such as vertically moving the pad support 9 relative to the main body of the frame 3. Additionally, as illustrated in FIGS. 4 and 5, it can be done by moving the main body of the frame 3 up and down relative to the floor caster 17. More specifically, the illustrated height adjustment is accomplished (see FIG. 5) by selectively rotating the horizontal shaft 19 clockwise or counterclockwise to rotate, in turn, the bevel gears 21 and 23. The bevel gear 23 as best illustrated in FIG. 6 is attached to the vertically extending, threaded shaft 25 of the floor caster 17. Rotation of the shaft 19 clockwise or counterclockwise by the servo motor 27 (see FIG. 5) will selectively move the main body of the frame 3 up or down relative to the caster 17. This, in turn, will serve to raise or lower the pad support 9 and attached pad 5 relative to the floor 15.

The method and apparatus of the present invention involve automatically operating the servo motor 27 to control the mechanism for raising and lowering the pad support 9 during the start-up sequence of the tool 1 in response to detecting whether or not there is a pad 5 on the pad support 9. That is, as discussed above, a problem currently exists with surface treating tools such as the floor polisher 1 that the operator may neglect to inspect the tool 1 to make sure a pad 5 is mounted on the pad support 9 before operating it. This is particularly true with tools that have exterior skirts or shrouds about the pad 5 or other surface treating member so that the pad 5 is not readily visible. With such tools, they generally must be tipped or otherwise manipulated in order to see whether or not a pad 5 is present. In the worse case, the operator may simply turn on the tool 1 without inspecting it wherein the pad support 9 (without a pad 5 attached to it) will be automatically lowered into engagement with the floor possibly resulting in significant damage to the floor 15 as well as to the pad support 9.

Figure 9:
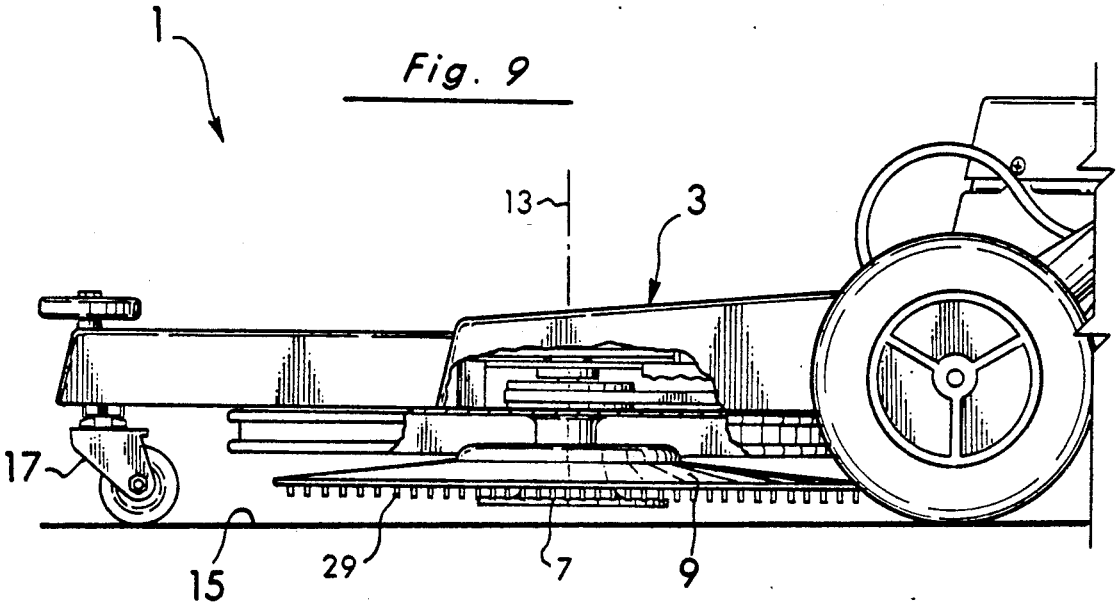
FIG. 9 illustrates the padless support in its up or home position spaced from the floor.

The pad support 9 (see FIGS. 7 and 9) is typically a hard plastic disk with a plurality of protruding pin members 29 (see also FIG. 4). These pin members 29 are designed to be pressed into the floor pad 5 to provide sufficient gripping force to enable the pad 5 to be rotated about the axis 13 with the pad support 9. The pin members 29 and pad attaching or mounting means 7 of support 9 are not designed to engage the floor surface 15 as significant damage to the floor (e.g., grinding) and damage to the pin members 29 and attaching means 7 of the pad support 9 may result. With tools that automatically raise and lower the pad support 9, it is not uncommon that if the operator does not check to see whether or not a pad 5 is on the pad support 9, the first indication he may have that the pad 5 is missing will be the sound of the pin members 29 and pad attaching or mounting means 7 contacting and grinding the floor surface 15. Alternately, if the padless support 9 does not engage the floor 15, the operator may end up running the tool 1 for some time with the padless support 9 simply rotating in a non-working position spaced above the floor 15. This is particularly true for tools with skirts or shrouds normally hiding or obscuring the pad 5 from view. With all prior floor tools and other surface treating tools (e.g., floor scrubbers, carpet cleaners) which have such automatic or powered mechanisms, there is no arrangement for automatically detecting the absence of a pad 5 or other surface treating member on the tool. There also is no arrangement for automatically alerting the operator to this condition and/or preventing the tool from being operated to lower the padless support such as 9 into potentially damaging contact with the floor 15.

Figure 8:
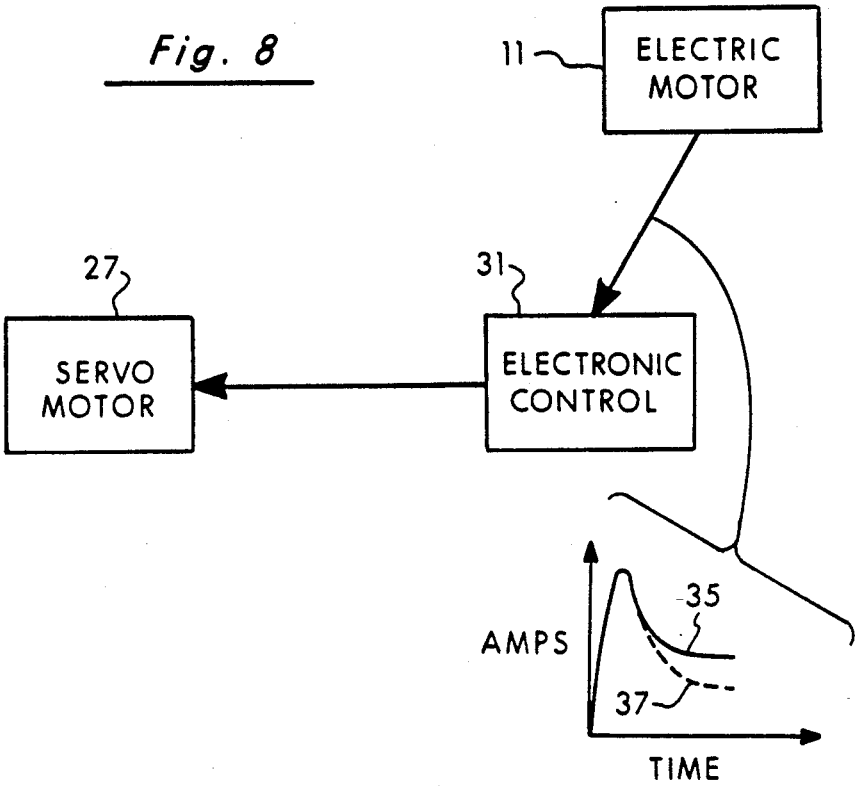
FIG. 8 is a schematic of the operation of the electronic control.

In this light, the present invention was developed. In use as schematically shown in FIG. 8, an electronic control 31 is provided to monitor the power draw (e.g., amperes) of the electric motor 11 which is rotating the pad support 9. The electronic control 31 then prevents the pad support 9 from being lowered by the servo motor 27 beyond a certain point if the amperes being drawn by the motor 11 fall below a certain amount (indicating the absence of a pad 5 on the pad support 9). More specifically, the electric motor 11 will draw more amperes when a pad 5 is on the rotating pad support 9 than when it is not. For example, the pad support 9 at or near its normal operating speed (e.g., 1500 or 2000 rpm's) and spaced from the floor 15 may draw more than, for example, seven amperes when a pad 5 is attached to it. Conversely, it may draw, for example, fewer than seven amperes without a pad 5 on it. During the start-up sequence of the tool 1, the operator will first turn on switch 33 (see FIG. 2). The electronic control 31 will then initially operate the servo motor 27 to raise the pad support 9 to its up or home position if it is not already there. In this first position, the pad support 9 and attached pad 5 are both spaced from the floor surface 15. As the electric motor 11 begins rotating the pad support 9, the servo motor 27 will rotate the shaft 19 to begin lowering the pad support 9 toward a second position (see FIG. 4) in which an attached floor pad 5 would normally engage the floor 15. This lowering to the second position may take, for example, five seconds. As this lowering is occurring, the electronic control 31 monitors the amperes being drawn by the electric motor 11. In doing so, the electronic control 31 would typically see an initial power surge of, for example, 30 amperes for a fraction of a second as the pad support 9 is brought up to its normal operating speed (e.g., 1500 or 2000 rpm's). Thereafter, and still during the five second descent period (see the graph of FIG. 8), the electronic control 31 expects to see the draw drop to the normal operating range 35 of the pad support 9 with an attached pad 5 (e.g., above seven amperes). However, if the amperage draw drops below seven amperes in our example and as illustrated by the dotted line 37 in the graph of FIG. 8, the electronic control 31 knows there is no pad 5 on the pad support 9 and immediately operates the servo motor 27 to raise the pad support 9 back to its up or home position. This is all done within the five second descent period. Any raising of the padless support 9 by the servo motor 27 is preferably done well before the pad support 9 is lowered to its second, operating position and certainly before it is lowered even farther into engagement with the floor 15. In further response to detecting the absence of a pad 5 on support 9, the electronic control 31 also activates a flashing light 39 (see FIG. 3) on the frame 3 to give a visual signal to the operator alerting him to the padless condition.

In the description of the preferred mode of operation, the electronic control 31 has been set forth as detecting an operating condition (i.e., an amperage draw below seven amperes) indicating the absence of a pad 5 and preventing the padless support 9 from being lowered to its normal operating position. Semanticly and operationally, the electronic control 31 can also be described and designed as detecting the converse operating condition (i.e., an amperage draw above seven amperes) and permitting the support 9 with the attached pad 5 to be lowered to its normal operating position with the pad engaging the floor 15. That is, the present invention has means for detecting the absence of a pad 5 and in such absence, it prevents the padless support 9 from being lowered. However, if a pad 5 is on the support 9, the electronic control 31 will not see fewer than, for example, seven amperes and in essence is detecting the converse operating condition (i.e., presence of a pad 5) and allowing the support 9 to be lowered. Thereafter, and since a pad 5 is present, the electronic control 31 will operate in its normal mode. In doing so, it will activate the servo motor 27 to raise or lower the pad support 9 and attached pad 5 to maintain the draw of motor 11 between, for example, eleven and fifteen amperes. Also, the monitoring of amperage draw of the electric motor 11 during the start-up sequence and thereafter is the preferred manner of operation. However, the characteristic being monitored can be any one that is proportional to or indicative of the power being used by the electric motor 11, battery, or other power source to drive the surface treating member (e.g., hydraulic pressure in a hydraulicly powered system, air pressure in a pneumatic system).

While several embodiments of the invention have been shown and described in detail, it is to be understood that various modifications and changes could be made to them without departing from the scope of the invention. For example, although the present invention is shown and described primarily in use with a floor polisher, it is equally adaptable to any number of surface treating tools such as floor scrubbers and carpet cleaners. Additionally, the surface treating member could be any number of ones being continuously rotated about one or more vertical, horizontal, or other axes as well as ones that are rotated back and forth in an oscillating manner about one or more axes or moved in any other reciprocating manner.

We claim:

1. A surface treating tool having:

a surface treating member, a frame, said frame including support means for said surface treating member, means for removably mounting said surface treating member to said support means, and means for moving said support means toward and away from a surface to be treated between at least a first position in which said surface treating member is spaced from said surface and a second position in which said surface treating member when mounted on said support means is engaged with said surface, and means for detecting an absence of said surface treating member on said support means.

2. The surface treating tool of claim 1 further including power means for driving said support means.

3. The surface treating tool of claim 2 wherein said power means exhibits a first operating condition when said surface treating member is mounted on said support means and said support means is away from said second position and said power means exhibits a second operating condition when said surface treating member is not mounted on said support means.

4. The surface treating tool of claim 3 wherein said detecting means detects said second operating condition and includes means for preventing said moving means from moving said support means to said second position in response to detecting said second operating condition.

5. The surface treating tool of claim 4 wherein said power means includes means for rotating said support means and said second operating condition being detected by said detecting means is proportional to the power being used by the power means to rotate said support means.

6. The surface treating tool of claim 4 wherein said power means includes an electric motor and in said second operating condition, said electric motor draws less than a predetermined amount of amperes wherein said detecting means detects said drawing of less than said predetermined amount of amperes by the electric motor and prevents said moving means from moving said support means to said second position in response thereto.

7. The surface treating tool of claim 3 wherein said detecting means detects said first operating condition and includes means for permitting said moving means to move said support means to said second position in response to detecting said first operating condition.

8. The surface treating tool of claim 7 wherein said power means includes means for rotating said support means and said first operating condition being detected by said detecting means is proportional to the power being used by the power means to rotate said support means.

9. The surface treating tool of claim 7 wherein said power means includes an electric motor and in said first operating condition, said electric motor draws more than a predetermined amount of amperes wherein said detecting means detects said drawing of more than said predetermined amount of amperes by the electric motor and permits said moving means to move said support means to said second position in response thereto.

10. The surface treating tool of claim 1 wherein said surface is a floor and said surface treating member is a floor pad.

11. The surface treating tool of claim 1 wherein said moving means moves said support means from said first position toward said second position and said detecting means detects the absence of said surface treating member as said support means is moved from said first position toward said second position.

12. The surface treating tool of claim 1 wherein said detecting means further includes means for generating a visual signal in response to detecting the absence of said surface treating member on said support means.

* * * * *